US007949236B2

(12) United States Patent
Marechal et al.

(10) Patent No.: US 7,949,236 B2
(45) Date of Patent: May 24, 2011

(54) HOME HEATING RADIATOR USING A PHASE CHANGE HEAT TRANSFER FLUID

(75) Inventors: Alain Marechal, Tullins (FR); Stéphane Colasson, Voreppe (FR)

(73) Assignee: Commissariat a l'Energie Atomique, Paris (FR)

( * ) Notice: Subject to any disclaimer, the term of this patent is extended or adjusted under 35 U.S.C. 154(b) by 450 days.

(21) Appl. No.: 12/132,107

(22) Filed: Jun. 3, 2008

(65) Prior Publication Data

US 2009/0041441 A1 Feb. 12, 2009

(30) Foreign Application Priority Data

Aug. 7, 2007 (FR) ..... 07 56987

(51) Int. Cl.
*F24D 13/04* (2006.01)

(52) U.S. Cl. ..... 392/357; 392/347; 392/378

(58) Field of Classification Search ..... 392/347, 392/357, 378

See application file for complete search history.

(56) References Cited

U.S. PATENT DOCUMENTS

| | | | | | |
|---|---|---|---|---|---|
| 1,556,491 | A | * | 10/1925 | Clark | 392/378 |
| 1,852,252 | A | * | 4/1932 | Mcintosh | 237/16 |
| 2,266,016 | A | * | 12/1941 | Fisher | 392/378 |
| 2,455,688 | A | * | 12/1948 | Malickson | 392/378 |
| 2,508,736 | A | | 5/1950 | Warden, Sr. | |

FOREIGN PATENT DOCUMENTS

| | | | |
|---|---|---|---|
| GB | 2 099 980 | A | 12/1982 |
| WO | 02/50479 | A1 | 6/2002 |

* cited by examiner

*Primary Examiner* — Thor S Campbell
(74) *Attorney, Agent, or Firm* — Burr & Brown

(57) ABSTRACT

A home heating radiator using a heat transfer fluid operating in phase change form, includes a reservoir of heat transfer fluid, and electric resistance heat source, for raising the temperature of the heat transfer fluid to a temperature such as to cause a phase change of the fluid, and a heating body where heat transfer takes place with the ambient air, the heating body including a number, n, of channels, communicating in the lowermost part of the reservoir, where n may be equal to 1.

6 Claims, 2 Drawing Sheets

HOME HEATING RADIATOR USING A PHASE CHANGE HEAT TRANSFER FLUID

FIELD OF THE INVENTION

The invention relates to a radiator intended more particularly for home heating, and operating using a heat transfer fluid. More specifically, the heat transfer fluid used in the radiator of the invention operates in phase change and in particular liquid-vapor form.

BACKGROUND OF THE INVENTION

Basically, two different types of electric home heating radiator are known. Firstly, electrical convection heaters, in which the ambient air to be heated is in direct contact with an electric heating resistance. These widely used electric convection heaters have the drawback of generating a strong movement of ambient air due to the thermal gradient created, causing discomfort to the occupants of the room concerned. This problem is partly solved by another type of radiator, called radiant heaters, operating by radiation.

Radiators using a heat transfer fluid are also known, in which said fluid, generally oil, is heated by an electric heating element and passes through a heating body, where the heat is transferred to the ambient air by natural convection. Due to the presence of the heating body, of which the heat exchange area is relatively large, the temperature gradient with the ambient air is reduced, so that the air movements by natural convection in the room concerned are limited.

Among these heat transfer fluid radiators, radiators in which the fluid operates in single-phase conditions are first distinguished. In these radiators, said fluid remains in the liquid state. In this case, the heat transfer fluid is heated in contact with an electric heating body, becomes less dense and rises inside the heating body. During its upward movement, the heat transfer fluid gives up part of the heat to the ambient air through the wall of the heating body, and commensurately cools. The fluid thus cooled, becoming denser, and therefore heavier, falls back by gravity to the lowermost part of the radiator. To ensure satisfactory operation of this type of radiator, it is therefore necessary to have a minimum temperature difference between the rising (hot) fluid and the descending (cold) fluid, which is directly dependent on the pressure losses of the fluid caused by its circulation. Accordingly, with this type of radiator, a nonuniform temperature distribution is observed in the wall of the heating body, which affects the efficiency of the radiator. Moreover, this type of operation can give rise to hotter spots on the surface of the apparatus, which are hazardous and also incompatible with the prevailing safety standards.

In order to overcome these drawbacks, document GB-A-2 099 980, for example, proposes a radiator using a heat transfer fluid operating in phase change conditions, in particular liquid/vapor conditions. Such a radiator operates as follows: the liquid heat transfer fluid rests by gravity in the lowermost part of the radiator traversed by a heating element, consisting of a fluid at elevated temperature, and passing through the base of said radiator in a sealed manner.

Under the effect of the heat, the heat transfer fluid is vaporized, said vapor thereby rising in the internal structure of the radiator, particularly at the level of the heating body, where the heat transfer occurs. As a corollary, since the temperature of the walls of said heating body is lower than that of the vapor, the latter condenses. The condensate thus formed is in liquid form, and returns to the lowermost part of the radiator by simple gravity.

This heat transfer mode, by phase change, and directly involving the latent heat of condensation, ensures a virtually uniform wall temperature of the heating body, accordingly constituting a very clear improvement over the heat transfer fluid radiators operating in single-phase conditions. This is because this transfer temperature is very close to the saturation vapor temperature of the heat transfer fluid owing to the much higher heat transfer coefficient in condensation than by natural convection from the outer side, that is the ambient air side. This achieves a substantial gain in the variation of the air temperature.

However, the heat source which raises the temperature of the heat transfer fluid proves to be relatively difficult to control, both in time and in space. Furthermore, it is observed that if the heat transfer fluid vaporization rate is too high, the vapor thereby generated entrains drops of heat transfer fluid, disturbing the satisfactory operation of the radiator.

Moreover, with such phase change radiators, the problem also arises of noise during startup. This noise is generated by the pressure waves during the collapse of the vapor bubbles in the subcooled liquid. Depending on the fluid used and the quantity of liquid fluid introduced into the radiator body, this noise generation may vary. In fact, this acoustic pollution may prove disturbing, or even prohibitive, for a number of applications, such as in particular hospital rooms, rest homes, retirement homes, or even simply bedrooms.

The present invention is precisely aimed to overcome these drawbacks, and in particular to propose a phase change radiator, that is both energy efficient and little or not noisy during its startup phase.

SUMMARY OF THE INVENTION

The invention relates to a home heating radiator using a heat transfer fluid operating in phase change form, in which firstly, the heat source of the heat transfer fluid consists of an electric resistance, which is advantageously hermetically sealed with regard to the heat transfer fluid of the radiator.

Secondly, the cross section S of the connection between the heat transfer fluid reservoir, located in the lowermost part of said radiator, and the heating body, which may have a plurality n of channels, where n may be equal to 1, is equal to or greater than the expression:

$$\frac{A \times P^{\frac{4}{5}}}{n},$$

where:

P denotes the power of the electric resistance;

n, as already stated, is the number of channels constituting the heating body;

and A is a constant which depends on the type of fluid and the temperature thereof (A is expressed in $m^2.W^{-4/5}$).

It is thus observed that, firstly, the use of such an electric resistance as a heat source of the heat transfer fluid serves to control the general operation of the radiator much more easily, both in time and in space.

Furthermore, the provision of connecting zones with a passage between the reservoir and the channels constituting the heating body satisfying the abovementioned equation, eliminates or at least drastically reduces the number of drops of heat transfer fluid in liquid form entrained by the vapor generated in the heat source, and accordingly optimizes the operation of the radiator.

Owing to the limitation of the superheating of the heat transfer fluid in liquid form in the reservoir, the noise liable to be generated by the collapse of the vapor bubbles is reduced.

In order to optimize the operation of the radiator of the invention, the zones connecting the channels of the heating body to the reservoir have their bottom part at a minimum distance δ above the upper tangent line of the electric heating resistance passing through the reservoir, said distance satisfying the equation $\delta \geqq 0.5 \times D$, where D is the diameter of said heating resistance.

In order to optimize the operation of the radiator of the invention, particularly to reduce noise during startup, the filling factor α must be higher than the value of 0.0142, said factor α being defined as the ratio of the mass of vapor produced at 20° C. to the total mass of fluid introduced into the radiator body.

BRIEF DESCRIPTION OF THE DRAWINGS

The manner in which the invention can be implemented and the advantages thereof will appear better from the exemplary embodiment described below, provided for information and nonlimiting, in conjunction with the appended figures.

DETAILED DESCRIPTION OF THE INVENTION

Figure 1:
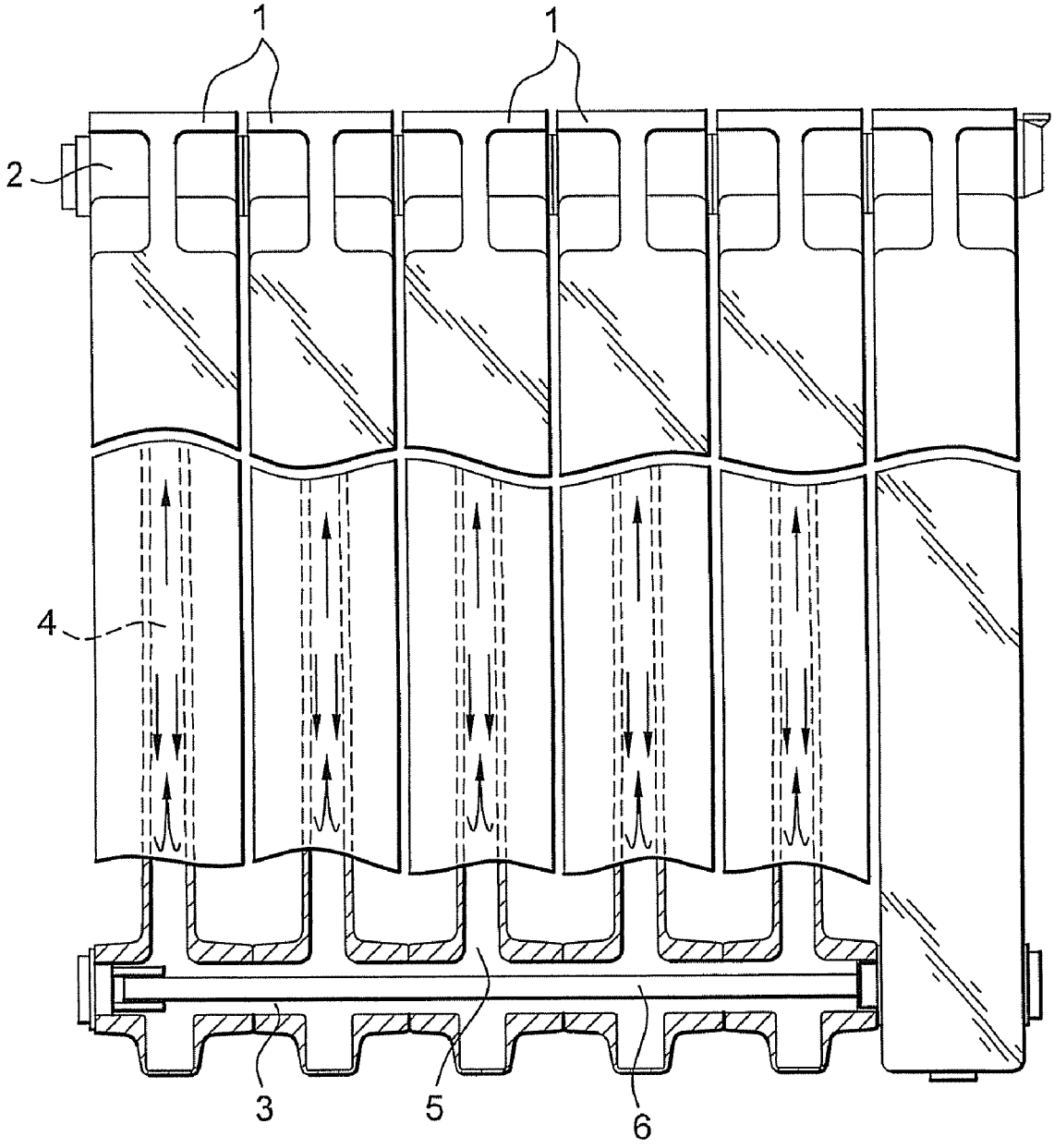
FIG. 1 is a partially exploded schematic representation of a known heat transfer fluid radiator.

FIG. 1 shows a heat transfer fluid radiator known per se. This radiator consists of a plurality of unit elements 1, constituting the heating body, all the elements being connected to a bottom reservoir 3.

These various elements 1 may, for example, be made from cast aluminum and, in order to optimize the transfer with the ambient air, may have fins 2 thereby promoting the diffusion of the heat in the room in which such a radiator is installed.

Within each of these elements 1 flows a heat transfer fluid, its type being adapted to the heat transfer function concerned. This fluid may be water, ethanol, or a synthetic polymer, such as for example R113 (chlorofluorocarbon, or HFR 7100®, sold by 3M, and consisting of hydrofluoroether).

The assembly of the various elements 1 together constitutes the actual heating body, and are each provided with a vertical channel 4, terminating in the lowermost zone at the reservoir 3 via a connecting zone 5.

Figure 2:
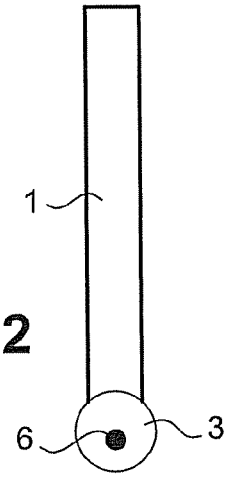
FIG. 2 shows a cross section of such a radiator, but according to the invention.

As may be observed in FIG. 2, an electric heating resistance 6 is inserted into the lower reservoir 3 and passes through it along substantially its whole length. Such a resistance may, for example, consist of a heating cartridge with double insulation.

According to one feature of the invention, the connecting zone 5 between the channel or channels 4 of the heating body and the reservoir 3 located in the lowermost part of said radiator has a cross section S satisfying the following expression:

$$S \geq \frac{AP^{\frac{4}{5}}}{n}$$

As previously stated:

P is the power of the electric resistance 6;

n is the number of channels 4 and hence the number of elements 1 constituting the heating body terminating in the same reservoir 3;

A is a constant, which depends on the type of fluid measured at a given temperature.

Experience shows that the most restrictive conditions relative to the heat transfer fluid appear when the latter is at a temperature close to 20° C., that is during the startup of the radiator initially presumed to be at the temperature of the room.

In these operating conditions, the constant A is:

for water A=0.0106;

for ethanol A=0.0125;

for HFE 7100® A=0.0153;

for R113 A=0.0117.

As a numerical application, for a radiator in which the heat transfer fluid is water, developing 1000 electric watts, and comprising ten elements 1, including ten channels 4 in parallel, the cross section of the connection 5 between each of the channels and the reservoir 3 must be larger than 0.27 $cm^2$.

However, for an organic fluid of the type HFE 7100® and in the same configuration, the cross section of the connecting zone 5 must be equal to or greater than 0.383 $cm^2$.

Figure 3:
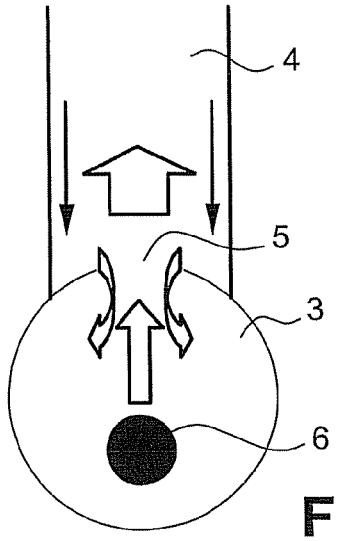
FIG. 3 is a detailed schematic representation of the cross section of the lowermost zone of said radiator.
Figure 4:
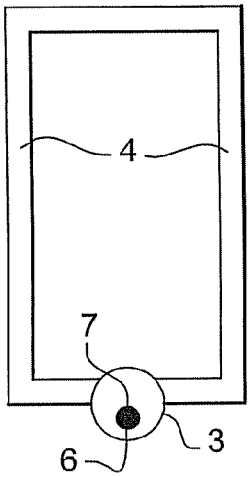
FIG. 4 is an illustration of an alternative embodiment of the invention.
Figure 5:
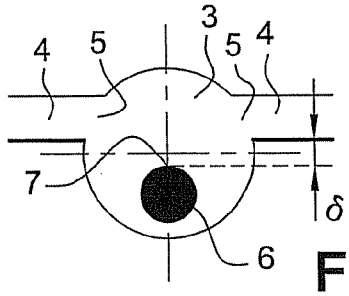
FIGS. 5 and 6 are schematic cross section views illustrating one of the features of the invention.
Figure 6:
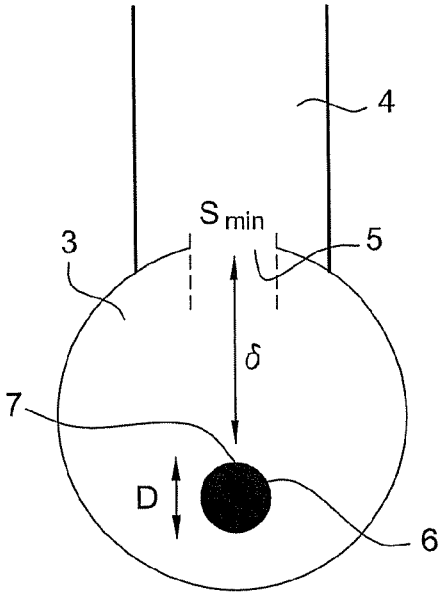

FIG. 3 illustrates the operating mode of such a radiator. The upward arrows illustrate the vaporization and upward movement of the heat transfer fluid in the vapor phase in the heating body, and the downward arrows illustrate said fluid which is condensed by contact with the side walls of the channel 4 concerned, falling back in liquid form and by simple gravity into the reservoir 3 via the connecting zone 5.

It can be understood that owing to the use of an electric resistance 6, the operation of such a radiator can be controlled much more effectively and more instantaneously, contrary to the prior art devices previously described.

The electric resistance 6 is further dimensioned so that the heat flux density at the surface thereof does not exceed 3 watts per $cm^2$ in order to vaporize the heat transfer fluid in the form of small bubbles and consequently to reduce the noise commonly generated in heat transfer fluid radiators. Typically, for a radiator of 1000 electric watts, the surface area of the heating rod or electric resistance 6 in contact with the heat transfer fluid must be greater than 330 $cm^2$, regardless of the number of channels and regardless of the heat transfer fluid.

According to one feature of the invention, the zone 5 connecting the channels 4 at the level of the reservoir 3 terminates above the maximum upper tangent line 7 of said heating rod 6 by a distance δ equal to or greater than 0.5×D, where D is the diameter of the heating rod or electric resistance 6.

In fact, the vapor must be able to flow toward the heating body, so that the connecting zone must not be flooded.

According to another feature of the invention, the filling factor α of the radiator is higher than 0.0142, the factor α being defined by the following equation:

$$\alpha = \frac{\text{mass of vapor at } 20^\circ\ C.}{\text{total mass of fluid}}$$

The mass of vapor at 20° C. is determined by the following equation:

$$\text{mass of vapor at } 20°\ C. = \frac{V_R - \upsilon_l M}{\upsilon_v - \upsilon_l}$$

where:

$V_R$ is the internal volume of the radiator (in $m^3$);

M denotes the total mass of fluid introduced into the radiator (in kg);

$\upsilon_V$ denotes the specific volume per unit mass of the vapor at saturation at 20° C. (in $m^3$/kg);

and $\upsilon_1$ denotes the specific volume per unit mass of liquid at saturation at 20° C. (in $m^3$/kg).

Thus, for a radiator having an internal volume of 4 liters (0.004 $m^3$), and for 200 ml of fluid introduced, the following values are obtained:

for HFE 7100®:

M=0.299 kg $\upsilon_1$=0.00067 $m^3$/kg $\upsilon_V$=0.428 $m^3$/kg mass of vapor: 0.0089 kg $\alpha$=0.0299 for water:

M=0.199 kg $\upsilon_1$=0.001 $m^3$/kg $\upsilon_V$=57.8 $m^3$/kg mass of vapor: 0.000065 kg $\alpha$=0.0003 for ethanol

M=0.158 kg $\upsilon_1$=0.00126 $m^3$/kg $\upsilon_V$=9.07 $m^3$/kg mass of vapor: 0.0004 kg $\alpha$=0.0026

The radiator is observed to operate satisfactorily with regard to noise if the filling factor $\alpha$ is higher than 0.0142.

This criterion is satisfied by introducing a maximum of 400 ml of HFE 7100®, 5 ml of water or 39 ml of ethanol into a radiator having an internal volume of 4 liters.

However, under such conditions, only HFE 7100° satisfies both the objectives of heat transfer efficiency and acoustic level.

Thus, the radiator of the invention serves to overcome the various drawbacks mentioned in connection with the prior art radiators simply, effectively, and also serves to control the operation of such a radiator more easily.

The invention claimed is:

1. A home heating radiator using a heat transfer fluid operating in phase change form, comprising:

a reservoir of said heat transfer fluid;

a heat source, consisting of an electric resistance, for raising the temperature of said heat transfer fluid in the reservoir to a temperature such as to cause a phase change of said fluid;

a heating body where heat transfer takes place with the ambient air, comprising a number n of channels, communicating in the lowermost part of the reservoir, where n is at least equal to 1, wherein the heat transfer fluid flows upward in each of the number n of channels and flows downward in the same channel of the number n of channels, and wherein the cross section S of the connecting zones separating the heat transfer fluid reservoir from the channels constituting the heating body, is equal to or greater than the expression:

$$\frac{A \times P^{\frac{4}{5}}}{n}$$

where:

P denotes the power of the electric resistance; and

A is a constant which depends on the type of fluid and the temperature thereof.

2. The home heating radiator using heat transfer fluid as claimed in claim 1, wherein the zone connecting the channels constituting the heating body at the level of the reservoir terminates above the electric resistance.

3. The home heating radiator using heat transfer fluid as claimed in claim 2, wherein the distance $\delta$ between the lower limit of the connecting zone and the upper tangent line of the electric resistance satisfies the expression:

$$\delta \geqq 0.5 \times D$$

where D denotes the diameter of said heating resistance.

4. The home heating radiator using heat transfer fluid as claimed in claim 1, wherein the filling factor $\alpha$, defined as the ratio of the mass of heat transfer fluid vapor produced at 20° C. to the total mass of said fluid introduced into the radiator body, satisfies the following equation: $\alpha$>0.0142.

5. The home heating radiator using heat transfer fluid as claimed in claim 1, wherein the heat transfer fluid is selected from the group consisting of water, ethanol or a hydrofluoroether.

6. The home heating radiator using heat transfer fluid as claimed in claim 1, wherein the heat transfer fluid is in a vapor phase when flowing upward in each of the number n of channels and is in a liquid form when flowing downward in the same channel of the number n of channels.

* * * * *